US008291883B2

(12) United States Patent
Ludwigsen

(10) Patent No.: US 8,291,883 B2
(45) Date of Patent: Oct. 23, 2012

(54) STUCK THROTTLE IGNITION INTERRUPTING DEVICE

(76) Inventor: Daniel Christian Ludwigsen, Hope Mills, NC (US)

( * ) Notice: Subject to any disclaimer, the term of this patent is extended or adjusted under 35 U.S.C. 154(b) by 301 days.

(21) Appl. No.: 12/752,885

(22) Filed: Apr. 1, 2010

(65) Prior Publication Data

US 2010/0251989 A1 Oct. 7, 2010

Related U.S. Application Data

(60) Provisional application No. 61/165,725, filed on Apr. 1, 2009.

(51) Int. Cl.
*F02D 17/00* (2006.01)

(52) U.S. Cl. ..... 123/198 DC; 123/198 D; 74/513; 180/118

(58) Field of Classification Search ..... 123/198 DC, 123/198 D, 397; 74/513
See application file for complete search history.

(56) References Cited

U.S. PATENT DOCUMENTS 3,273,552 A 9/1966 Plath
3,487,183 A * 12/1969 Schulman ..... 200/61.89
3,620,324 A 11/1971 Smitley
3,695,379 A * 10/1972 Veilleux ..... 180/271
3,703,162 A * 11/1972 Aono ..... 123/325
3,901,207 A * 8/1975 Remaud ..... 123/198 DB
4,856,471 A * 8/1989 Pettinelli ..... 123/198 DC
4,870,934 A * 10/1989 Vanetta et al. ..... 123/336
5,241,936 A * 9/1993 Byler et al. ..... 123/399
5,416,295 A 5/1995 White et al.
6,209,418 B1 * 4/2001 Kalsi et al. ..... 74/513
6,666,106 B1 * 12/2003 Hueges et al. ..... 74/514
6,874,468 B2 * 4/2005 Watanabe ..... 123/377
7,111,524 B2 * 9/2006 Kiczek et al. ..... 74/512
7,322,345 B2 * 1/2008 Saito et al. ..... 123/529
2005/0252493 A1 * 11/2005 Simmons ..... 123/480

OTHER PUBLICATIONS

Nick Wingfield, "Concern Over Electronic Interference Grows", The Wall Street Journal, Feb. 4, 2010.

* cited by examiner

*Primary Examiner* — Noah Kamen
*Assistant Examiner* — Grant Moubry

(57) ABSTRACT

A device for interrupting an automobile ignition in the event of a stuck throttle comprising a multifunction accelerator pedal adapted to engage an interruption means for grounding the ignition in response to an undesirable throttle status, such that the pedal communicates an undesirable throttle status to the interruption means.

6 Claims, 4 Drawing Sheets

STUCK THROTTLE IGNITION INTERRUPTING DEVICE

CROSS-REFERENCE TO RELATED APPLICATIONS

This application claims the benefit of provisional patent application Ser. No. 61/165,725 filed Apr. 1, 2009 by the present inventor titled "LD Safety Pedal", which is incorporated herein by reference.

STATEMENT REGARDING FEDERALLY SPONSORED RESEARCH OR DEVELOPMENT

Not Applicable.

BACKGROUND OF THE INVENTION

1. Field of the Invention

The invention relates to a device and process for interrupting an automobile engine ignition in the event of a stuck throttle.

2. Description of Related Art

Modern automobiles utilize either mechanical linkages or electromechanical devices to translate accelerator pedal movement into engine throttle. Both systems are subject to failure. Electromechanical systems may fail due to electromagnetic interference, improper processing, or the like. Mechanically linked systems may fail when the cable, rod, or other throttle linkage breaks.

For example, in electromechanical systems, automobiles utilize electronic switches and sensors to detect pedal displacement. These switches transmit signals to processor modules programmed to process the signals. Processor control modules utilize these processed signals to perform calculation and further control other sensors, motors, actuators, switches and the like to govern internal combustion engine operation and braking operations. When electronic or programmed devices malfunction, the engine can rev up or remain throttled unintentionally beyond the control of the driver. In such cases, brake operation may be diminished or insufficient to control the automobile unless deceleration occurs. Unless the malfunction stops, deceleration may not be possible unless the vehicle crashes. Similarly, electromagnetic interference is a growing concern in the use of electronic sensors used to control automobile engines. As manufacturers utilize an increasing number of electronic controls and device in automobiles, the amount of electromagnetic interference or EMI increases. Additionally, EMI may be introduced from sources external to the automobile itself. EMI can cause electronic device to behave erratically. Such erratic behavior could lead to processing units receiving incorrect information regarding the displacement on an accelerator pedal assembly, thereby causing an automobile to accelerate uncontrollably. Even if a driver removes their foot from the accelerator pedal, EMI may still operate to send improper signals to electrical sensors causing uncontrolled acceleration to continue. Additionally, a driver may not be able to stop if the engine throttle system is "stuck" at full throttle.

Vehicles having mechanical linkages utilize accelerator return springs and similar device to return the accelerator pedal to a predetermined position after the accelerator pedal is released. These vehicles use mechanical linkages such as throttle cables, rods, or other similar linkages to operate internal combustion engine throttle bodies. Malfunction in these mechanical linkages can cause an internal combustion engine to accelerate uncontrollably.

Both electromechanical and mechanical accelerator systems can also suffer from inadvertent "catching" of the accelerator pedal on floor mats and the like. When accelerator pedals become stuck in this manner, the accelerator can remain at full throttle even though the driver is no longer depressing the pedal.

Accordingly, what is needed is a device and method for interrupting the ignition of an automobile in the event of a mechanical linkage failure, EMI, or other unwanted operation causing acceleration when an accelerator pedal is no longer depressed by the operator.

BRIEF SUMMARY OF THE INVENTION

In a preferred embodiment of the invention, a multifunction accelerator pedal comprises an elongated main pedal body having a first end affixed to a conventional throttle means. The throttle means communicates accelerator pedal displacement information to the engine throttle to accelerate or decelerate the engine revolutions and automobile velocity. The main pedal body has an end opposite the first end. This opposite end has a notch for engaging a locking lug on a cooperating, pivotally affixed lower pedal. The lower pedal and the main pedal body are electrically insulated from each other by conventional means. The main body pedal further has a grounding means, such as an insulated nut or insulated ground bolt affixed thereto that is further in electrical communication with the engine ignition. The insulated ground bolt is insulated from electrical contact with the main body pedal. A pedal pivot mount has a based affixed to the automobile frame and an upturned mounting structure for pivotally mounting the main pedal body and the lower pedal thereon in side-by-side relation. A locking lug projects from the lower pedal structure and is adapted to engage the main pedal body notch when the driver depresses the lower pedal. The engaged locking lug urges the main pedal body to pivot in unison with the lower pedal when the lower pedal is depressed. The main pedal body has a lug projecting downwardly adjacent the opposite end. The lug has a tip portion adapted for affixing a first end of a spring having a predetermined tension. The lower pedal has a positive stop extending downwardly from the end distal the face of the lower pedal. The positive stop supports the pedal assembly during idling by making positive contact with the pedal pivot mount base. The second end of the spring is affixed to the positive stop. The pedal assembly is arranged such that the positive stop and the first lug are in a predetermined offset relation about the pivot point of the pedal pivot mount. The spring tension tends urges the first lug and the pivot stop together within the available range of adjustment between the main pedal body and the lower pedal. The lower pedal further includes a pawl projecting radially outwardly from the end adjacent the pedal pivot stop. During idling and normal operation of the device the pawl projects outwardly over the ground bolt while maintaining a predetermined distance between them. When an undesirable throttle response or status occurs, an imbalance in the pressure applied to the lower pedal face by the driver's foot and the forces from the throttle means causes the spring to urge the main pedal body and the lower pedal to pivot in opposite directions about the pedal pivot mount pivot point. This movement brings the pawl into contact with the ground bolt, effectively creating a ground circuit between the engine ignition source and the car frame, which acts as the ground. Grounding the engine ignition source prohibits the ignition from firing so that the automobile can be brought to a controlled stop rather than accelerating uncontrollably.

Other embodiments may include alternate mechanical arrangements of the pedals such that the operational output is the same. Likewise, electrical switches may be utilized to ground the ignition upon an unfavorable throttle response.

The present invention will now be described with reference to the following drawings, in which like reference numbers denote the same element throughout.

DETAILED DESCRIPTION OF THE INVENTION

Figure 1:
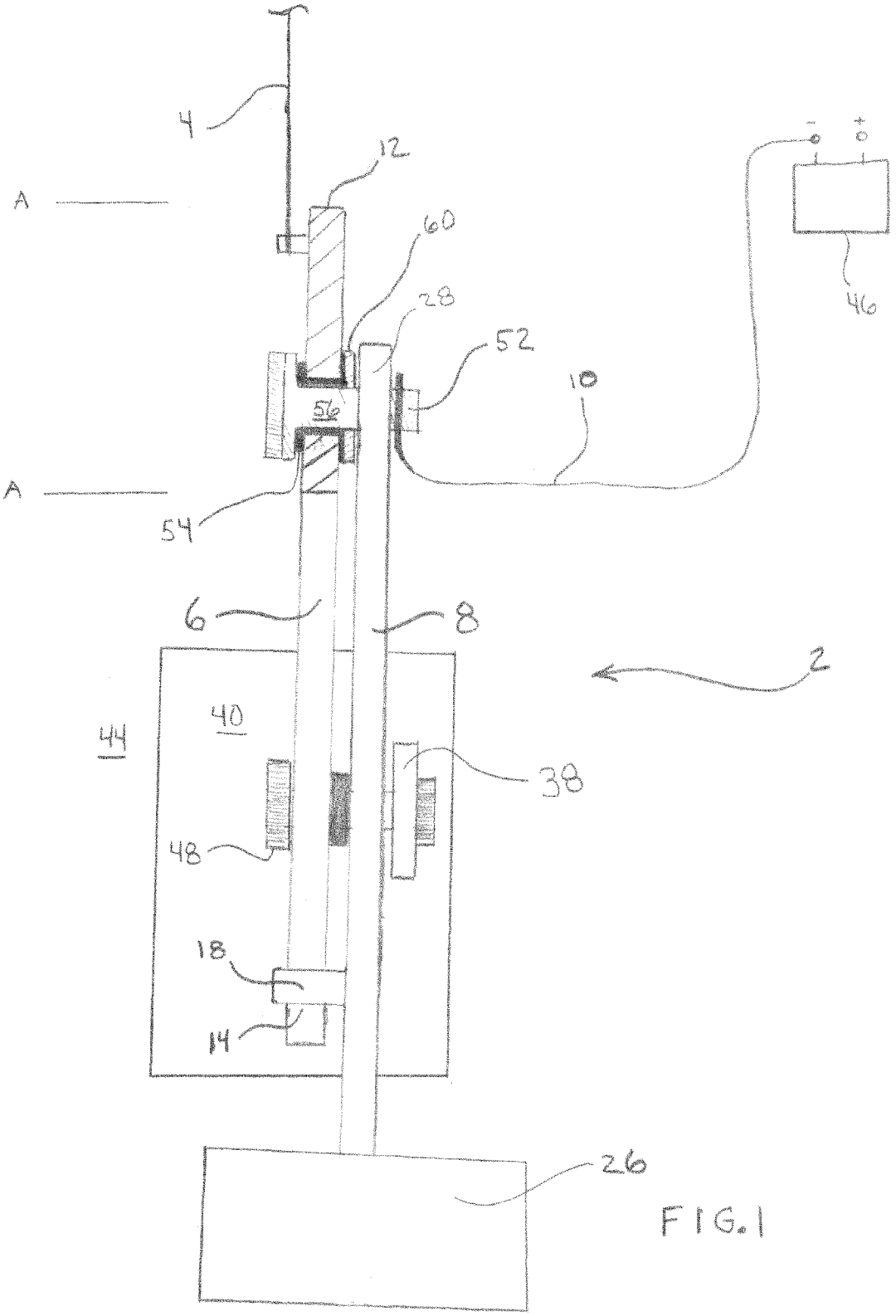
FIG. 1 is a plan view of an electronic accelerator pedal linkage in which the current invention is practiced having a partial cutaway portion A-A.
Figure 2:
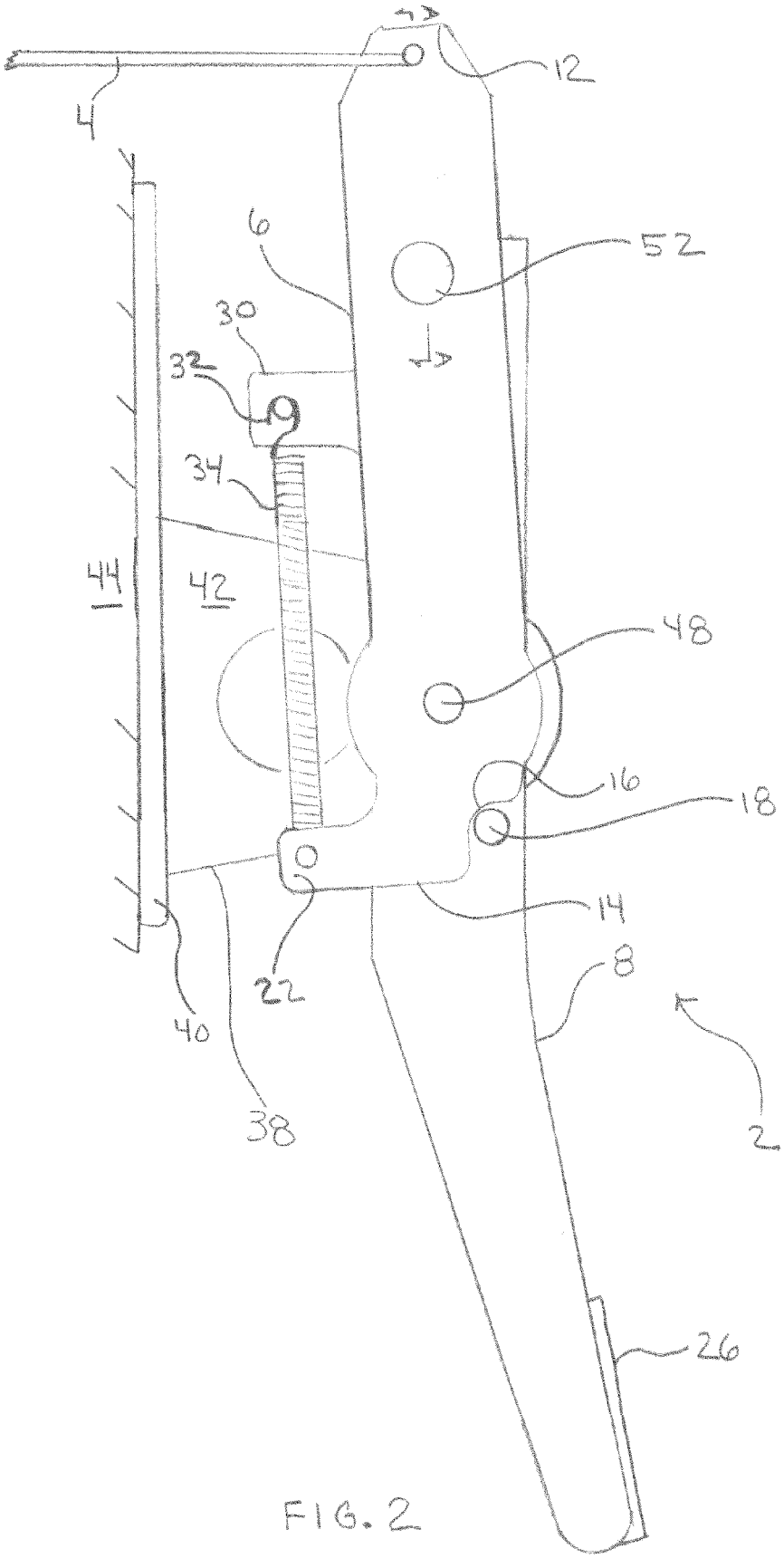
FIG. 2 is a side elevation view of an electronic accelerator pedal device in which the current invention is practiced.
Figure 3:
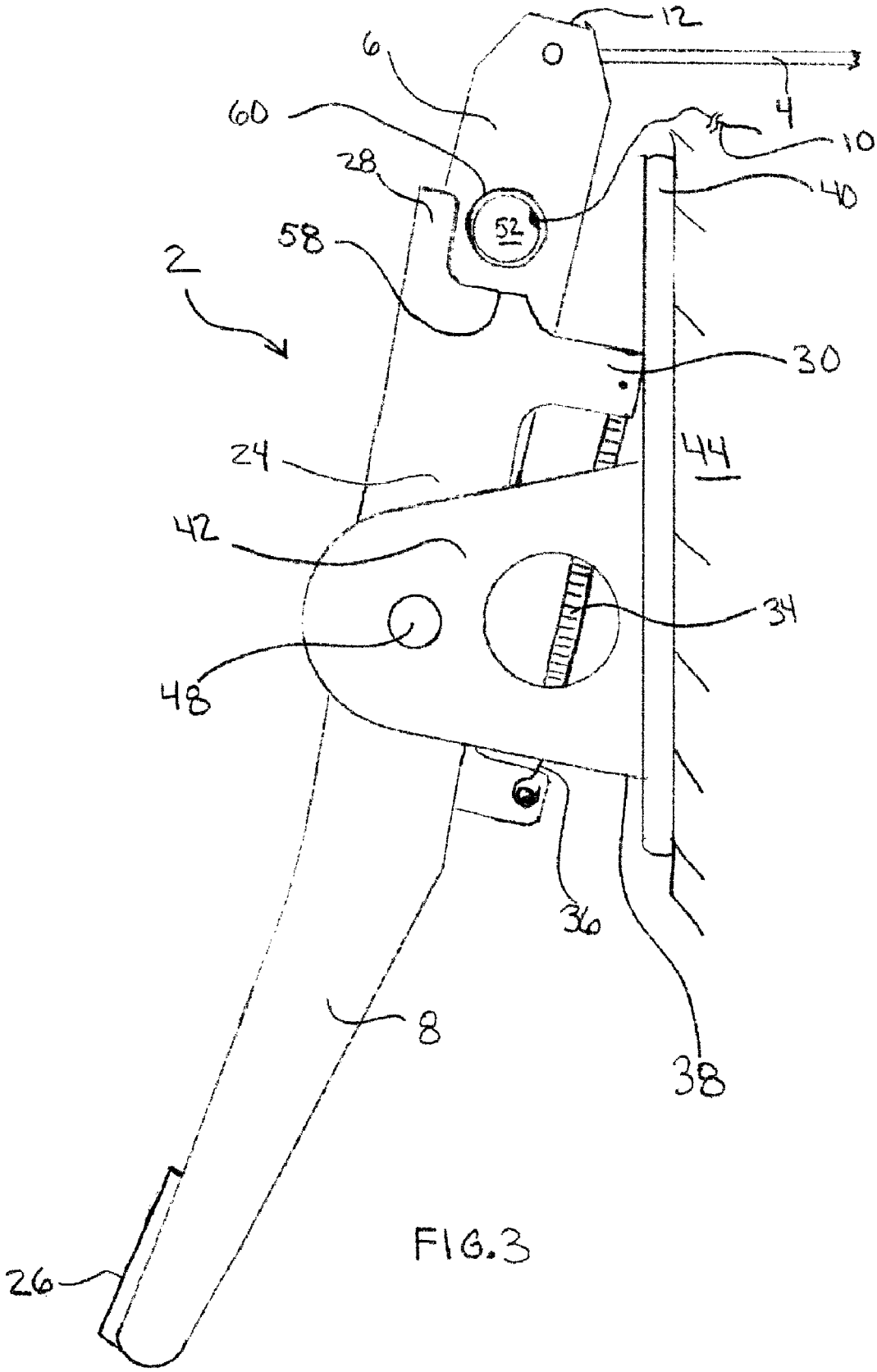
FIG. 3 is another side elevation view of an electronic accelerator pedal device in which the current invention is practiced having a sensor in the "open" position.

FIG. 1 through FIG. 3 depict a preferred embodiment of a multifunction, multi-component accelerator pedal device 2. The device 2 comprises a lower pedal 8 operably attached to a main pedal body 6. In this application, the lower pedal 8 may be alternately referred to as an activator, and the main pedal body 6 may be alternately referred to as an upper pedal. In the illustrated embodiment, the lower pedal 8 pivotally secures to the main pedal body 6 via a bolt 48 passing through the main pedal body 6 and the lower pedal 8 at a pivot point. The bolt 48 further passes through a pedal pivot mount 38, and a nut screwed onto the end of the threaded bolt 48 operably secures the assembly. Alternate forms of pivotal attachment means may also be used, such as pins, rods, and the like. A pedal pivot mount 38 has a base 40 that affixes to a automobile frame 44. The pedal pivot mount 38 further has a generally arcuate upturned portion 42 perpendicular to the base 40 having a bolt-hole there through for receiving a threaded portion 56 of the bolt 48. The pedal pivot mount 38 is preferably constructed of metal and may be stamped, machined, or otherwise manufactured from metal. Metal is preferred, but other materials having similar properties and electrical conductivity would be suitable. Conductivity is important where the pedal pivot mount 38 is acting as a part of the electrical grounding loop for grounding an ignition 46 as further discussed herein. The pedal pivot mount 38 may be welded, bolted, or otherwise affixed to the automobile chassis or frame 44 utilizing conventional means.

In the illustrated embodiment, the main pedal body 6 comprises an elongate pedal body having a first end 12 affixed to a throttle means 4 such as a throttle body cable, sensor or other such conventional device 2 or component. The main pedal body 6 may be easily formed from a single piece of bar stock by stamping operations, machining, water-cutting, milling, drilling, or other similar operations. The throttle means 4 may be any of the conventional throttle means 4 for communicating accelerator positions to the internal combustion engine throttle known in the art. Throttle cables are well-known throttle means 4 known in the art. U.S. Pat. No. 5,416,295 to White et al. (incorporated herein by reference) is an example of an accelerator pedal utilizing position sensors and transducers to electrically determine pedal position and displacement for electrically communicating throttle information to electronically controlled engines. The opposite end has an up-facing notch 16 forming a notched end 14. The notched end 14 is adapted to receive a mating locking lug 18 projecting outwardly from the side of the lower pedal 8. When the automobile driver depresses the lower pedal 8 face 26 to accelerate the vehicle, the lower pedal 8 pivots about the nut affixed to the pivot mount causing the locking lug 18 to almost instantaneously engage the mating notch 16. Thereafter, the locking lug 18 contact with the notch 16 causes the main pedal body 6 to cooperatively pivot about the pivot bolt 48 with the lower pedal 8. As the main pedal body 6 moves the throttle means 4 is displaced, communicating with the internal combustion engine throttle mechanisms to accelerate or decelerate the automobile.

The main pedal body 6 further has a first lug 22 projecting downward adjacent the notch 16. The first end 36 of a spring 34 affixes to the first lug 22. A second end 32 of the spring 34 affixes to a positive stop 30 projecting downwardly from the lower pedal 8. The spring 34 may be affixed by any conventional means known in the art. The positive stop 30 is positioned on the lower pedal 8 end 58 distal the face 26, and further described as disposed on the opposite side of the pivot point from the face 26. As pictured, the first lug 22 and the positive stop 30 oppose each other about the pivot point of the pivot bolt 48. The spring 34 has a predetermined tension chosen to urge the first lug 22 and the positive stop 30 together. During normal vehicle deceleration, the spring 34 tension ensures that the locking lug 18 and the notch 16 maintain contact since driver pressure on the pedal is reduced or removed. During idle operation, the positive stop 30 rests against a portion of the base 40, positioning the lower pedal 8 relative to the automobile floorboard. In operation, the spring 34 tension will be significantly less than the tension of the pedal return spring mechanisms since the interruption means response must be more sensitive to input.

The main pedal body 6 further has a grounding means 10 in the form of an insulated ground bolt 52 secured to the main pedal body 6. An insulator 54, such as a nylon collar, bushing, or the like, enshrouds the portion of the ground bolt 52 passing through the main pedal body 6. Likewise, a nut 60 securing the ground bolt 52 to the main pedal body 6 should be insulated such that the ground bolt 52 and nut 60 do not make electrical contact with the main pedal body 6. The ground bolt 52 is electrically connected by conventional means to a wire in electrical communication with the ignition 46 coil negative terminal. The lower pedal 8 is grounded to the frame 44 through its conventional mechanical connection to the pedal pivot mount 38 that is affixed to the frame 44. The lower pedal 8 end 58 distal the face 26 clears the ground bolt 52 by a predetermined distance that ensures the lower pedal 8 distal end 58 does not contact the ground bolt 52 during normal operation. A pawl 28 extends outwardly from the lower pedal 8 distal end 58 and over the ground bolt 52. The pawl 28 remains in close proximity with the ground bolt 52 during normal operation without making a mechanical or electrical connection. The spring 34 tension should be selected or adjusted such that no connection is made between the ground bolt 52 and the pawl 28 during idling. During idling, the positive stop 30 rests against the base 40. A predetermined distance selected to prevent accidental electrical connection of the pawl 28 and the ground bolt 52 separates the ground bolt 52 and the pawl 28. Spring 34 tension selection ensures that the main pedal body 6 and the lower pedal 8 maintain positions relative to each other during idling and normal operation so the pawl 28 and the ground bolt 52 do not make contact. As described, the ground bolt 52 and pawl 28 are the interruption means since their connection grounds out the ignition 46, preventing the engine from firing.

Throttle sticking even when the accelerator pedal assembly (i.e. the device 2) is not depressed is an example of an undesirable throttle status. If the throttle means 4 becomes stuck, the spring 34 tension will pivot the main pedal body 6 and the lower pedal 8 causing the pawl 28 to contact the ground bolt 52 when pressure is removed from the lower pedal 8 face 26. Likewise, if the throttle means 4 looses tension while the lower pedal 8 is depressed, the spring 34 would once again pivot the main pedal body 6 assembly such that the pawl 28 and the ground bolt 52 contact. Contact between the ground bolt 52 and the pawl 28 causes the ignition 46 system to become grounded, losing the ability to fire the engine. This operation helps to ensure that uncontrolled acceleration situations caused by throttle means 4 failure or a stuck pedal does not lead to an accident. Rather, the driver can bring the automobile to a controlled stop. Those skilled in the art will appreciate the inventive design of this pedal assembly, and the variations that may be made in lug position, pivot point arrangement, grounding means 10, and the like now that the inventive concepts are known. It should also now be recognized that alternate methods of interruption may be utilized in lieu of the ground bolt 52 and pawl 28. For example, the ground bolt 52 might be replaced with a push to make switch activated by the pawl 28. When an undesirable throttle status occurs, the pedal assembly pivoting would bring the pawl 28 in contact with the switch, making the electrical connection and grounding the ignition 46.

Figure 4:
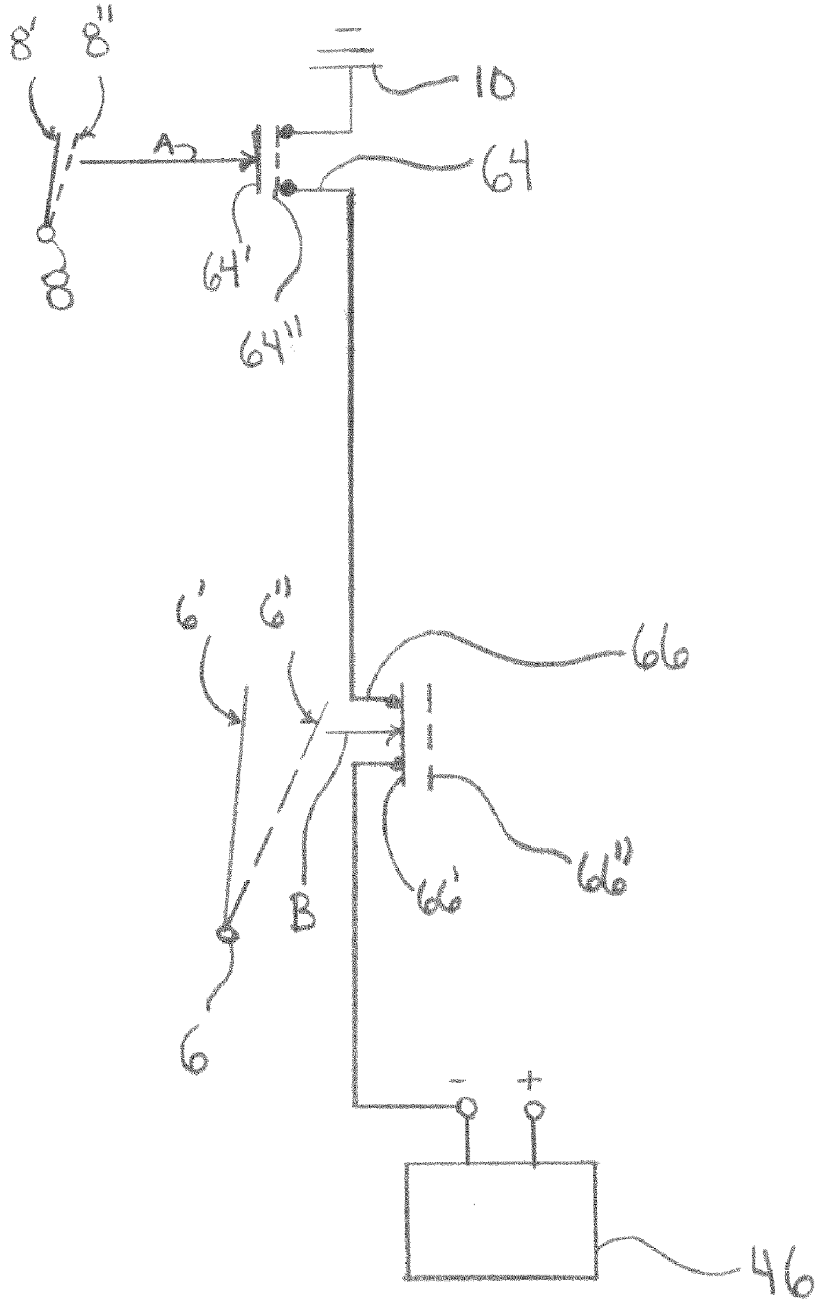
FIG. 4 schematically depicts operation of electrical components of the device in idle mode, normal operation mode, and undesirable throttle status modes.

FIG. 4 shows the grounding operation schematically using two switches. In the idle state, the lower pedal body 8 exerts no force on a pressure sensitive switch 64 (referred to herein as PSS). The PSS 64 is a push to break switch. In the idle state, the lower pedal body 8 is in position 8' and the PSS 64 is closed in position 64". When the lower pedal body 8 is depressed to position 8", the pedal 8 immediately contacts the PSS 64 with force A such that the PSS 64 is opened and moved to position 64'. The other terminal of the switch is connected to a ground means 10 as shown. As the device 2 assembly is further depressed, including the main body pedal 6 (which is at position 6' at idle), the main body pedal 6 moves to position 6", contacting a throttle position switch (herein referred to as TPS 66) with force B. The TPS 66 is a push to make switch. When depressed the TPS 66 moves from an open position 66' to the closed position 66". The other contact of the TPS 66 is in electrical communication with the negative pole of the ignition 46 of the automobile. During normal operations, the lower body pedal 8 is depressed, ensuring no electrical connectivity between the ignition 46 and the ground means 10. However, when an undesirable throttle condition is present, such as removal of force from the lower body pedal 8 without the movement of the main body pedal 6, the circuit is completed between the ground means 10 and the ignition 46 preventing firing.

The preferred embodiment illustrated in FIGS. 1-3 generally encompasses the switch scheme illustrated in FIG. 4, except that the TPS 66 is eliminated. Elimination of the TPS 66 is possible through the inventive use of the locking lug 18, notch 16, and the affixed spring 34 as previously described. The locking lug 18 maintains contact with the notch 16 during all accelerating operations where the driver depresses the device 2 pedal assembly. When pressure is removed from the device 2, the spring 34 tension operates to urge opposing ends of the main pedal body 6 and the lower pedal 8 in opposite rotation directions. With the exemplified arrangement of the locking lug 18 and the notch 16, this counter-torque ensures that the locking lug 18 remains seated in the notch 16 during normal operations. However, if pressure is removed from the device 2 but the accelerator means remains throttle or is hung, the spring 34 tension operates to bring the pawl 28 in contact with the grounding bolt 48 as previously explained. Thus, in alternate embodiments the TPS 66 can be mechanically eliminated from the device 2 while the device still performs the same function.

As has been demonstrated, the present invention provides a novel device 2 and method for interrupting an automobile internal combustion engine ignition in response to an undesirable throttle condition. The present invention can be used or retrofitted to most automobiles, or retrofitted onto existing accelerator pedals. The prior art does not include teachings of ignition interruption device as disclosed herein.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. A device for interrupting an automobile ignition in the event of a stuck throttle comprising:

a multifunction accelerator pedal comprising:

an elongate main pedal body comprising:

a first end communicably engaging an internal combustion engine throttle means; and an opposite notched end having a notch;

a lower pedal comprising:

an elongate structure;

a face in perpendicular relation to the elongate structure, the face adapted for depression during use;

a locking lug protecting from the structure for engaging the notch when the face is depressed; and a pawl distal the face;

wherein the lower pedal is pivotally affixed to the main pedal body via a pivot mount disposed at a position along the elongate structure intermediate the face and the pawl;

an interruption means for grounding the ignition in response to an undesirable throttle status;

the multifunction accelerator pedal adapted for engaging the interruption means such that the multifunction accelerator pedal communicates the undesirable throttle status to the interruption means and engages the interruption means in response to the undesirable throttle status thereby grounding the ignition.

2. The device according to claim 1 wherein the interruption means further comprises:

a throttle body switch in series communication with a pressure sensitive switch;

the throttle body switch and the pressure sensitive switch in series communication between the ignition and a ground such that simultaneous closure of the throttle body switch and the pressure sensitive switch grounds the ignition, thereby preventing engine firing.

3. The device according to claim 2 wherein the throttle body switch is a push to make switch and the pressure sensitive switch is a push to break switch.

4. The device according to claim 2 wherein the throttle body switch is a push to break switch and the pressure sensitive switch is a push to make switch.

5. The device according to claim 1 wherein the multifunction pedal further comprises:

an activator operably disposed on the main pedal body engaging a pressure sensitive switch when the activator and the main pedal body are operably depressed to accelerate the automobile.

6. The device according to claim 1 wherein the multifunction pedal further comprises:

an insulated grounding means adjacent the first end of the main pedal body, the grounding means in electrical communication with a ground; the opposite notched end further having a first lug projecting therefrom; and wherein the lower pedal further comprises a positive stop adjacent the pawl adapted to position the main pedal body position relative to the automobile when the device is not in use, the positive stop further adapted to receive a first end of a spring having a predetermined tension, the spring having a second end affixed to the first lug such that the spring tension urges the pawl into contact with the insulated grounding means in response to the undesirable throttle status.

* * * * *